United States Patent [19]

Akazawa et al.

[11] Patent Number: 4,519,888

[45] Date of Patent: May 28, 1985

[54] ELECTROLYTIC CELL

[75] Inventors: Michihiro Akazawa, Shinnanyo; Nobuhiro Kawasaki, Yamaguchi, both of Japan

[73] Assignee: Toyo Soda Manufacturing Co., Ltd., Shinnanyo, Japan

[21] Appl. No.: 571,884

[22] Filed: Jan. 18, 1984

[30] Foreign Application Priority Data

Jan. 19, 1983 [JP] Japan ..... 58-5827

[51] Int. Cl.[3] ..... C25B 9/00; C25B 11/03; C25B 11/10; C25B 11/04

[52] U.S. Cl. ..... 204/252; 204/283; 204/284; 204/288; 204/289; 204/290 F; 204/292

[58] Field of Search ..... 204/252, 253, 283, 282, 204/279, 263–266, 290 F, 292, 288, 289

[56] References Cited

U.S. PATENT DOCUMENTS

| | | | |
|---|---|---|---|
| 3,859,197 | 1/1975 | Bouy et al. | 204/254 |
| 3,980,545 | 9/1976 | Lachaux et al. | 204/254 X |
| 4,017,375 | 4/1977 | Pohto | 204/255 |
| 4,108,752 | 8/1978 | Pohto et al. | 204/256 |
| 4,402,809 | 9/1983 | Dilmore et al. | 204/254 |

*Primary Examiner*—Donald R. Valentine

*Attorney, Agent, or Firm*—Armstrong, Nikaido, Marmelstein & Kubovcik

[57] ABSTRACT

Electrolytic cell of single electrode type or multiple electrodes type, which is divided into the anode chamber and the cathode chamber with employing a cation exchange membrane and used for the electrolysis of the aqueous solution of alkali chloride, characterized in comprising (a) anode chamber and cathode chamber, (b) partition having a thickness of less than 6 mm to separate the anode chamber from the cathode chamber, (c) ribs joining the electrode with the partition.

3 Claims, 4 Drawing Figures

ELECTROLYTIC CELL

DETAILED DESCRIPTION OF THE INVENTION

The present invention relates to an electrolytic cell for the aqueous solution of alkali chloride employed a cation exchange membrane and, in particular, characterized by that a thickness of the partition separating the anode chamber from the cathode chamber is substantially less than 6 mm. A process is publicly known to produce chlorine and caustic soda through the electrolysis of the common salt solution employing cation exchange membrane as a diaphragm. The electrolysis employing cation exchange membrane is a process having attracted an attention in recent, since the amount of the common salt contaminating the caustic soda solution produced at cathode is extremely low and there are no pollution problems compared with the mercury method, the asbestos diaphragm method or the like.

As a result of the development or the improvement in the cation exchange membrane to raise the concentration of the caustic soda solution produced in the cathode chamber and also the efficiency of the current, it has become possible recently to obtain the caustic soda solution having a concentration of over 30% with a high current efficiency more than 90%. Moreover, a cation exchange membrane based on the perfluorocarbon polymer has been developed and commercialized partly now.

On the other hand, the importance of the energy economy has recently been recognized worldwidely, and it is strongly desired for the electrolytic power, that is, for the electrolytic voltage of the electrolytic cell to decrease as low as possible.

In the past, various means were proposed to escape the generated gas more easily to the backside of the electrode for the purpose of lowering in the voltage of the electrolytic cell. Among them, there are processes employed the porous electrodes such as expand metal, punched metal, metallic wire, etc., specified the composition or the type of exchange group of the cation exchange membrane, and the like. Moreover, as the means for lowering in the voltage of the electrolytic cell, such modifications of the structure of the cell as the circulation of liquid, the separation of gas from liquid, the reduction of distance between electrodes, and the like are proposed. Furthermore, recently, as a process electrolyzing in such a state as the distance between electrodes is substantially zero and the electrodes contact with the membrane closely, a technique called SPE process (Solid Polimer Electrolyte Process) is laid open under, for example, Japan Unexamined Patent Publication No. 102278/1978, etc. from a viewpoint of the saving of energy.

Also, for the purpose of a further reduction in the power consumption similarly from the standpoint of the saving of energy, various developments of the cathode having a hydrogen overvoltage lower than iron have been made, as laid open publicly, for example, under Japan Unexamined Patent Publication No. 92295/1980, No. 61248/1981, etc.

However, in these processes employing the active cathode, a phenomenon is observed that the concentration of iron ion in the caustic soda solution in cathode chamber increases extremely for a short period. This phenomenon further appears more remarkably under the severe electrolytic conditions to intend a higher temperature and a higher alkali concentration. Therefore, it is conceivable that the cathode chamber should be constructed using nickel metal having a corrosion resistance to alkali.

However, it has been considered that the use of nickel material for all the construction metal of the cathode chamber as a substitute for the carbon steel is expensive and impractical. With regard to the electrolytic cell employing the cation exchange membrane, both a double electrode type and a single electrode type in filter press form are used presently as practical cells.

However, owing to the structure of the electrolytic cell, feeding-discharging system of current is complicate in the case of the latter type, whereas electrically connecting system in the partition between the cathode chamber and the anode chamber is apt to become complicate in the case of the former type.

As an electrically connecting system used in the double electrode type, a screwing-in type or an explosively welding type inserting the metal having a resistance to the hydrogen permeability is laid open under, for example, Japan Unexamined Patent Publication No. 43377/1976, etc. These processes have, however, many difficulties such as increase in the resistance on the running of the electrolytic cell over a long period, a rapid occurrence of the corrosion, and the like as well as the expensiveness.

As a result of extensive investigations in order to solve these problems at a single stroke, the inventors have found that, in the electrolytic cell for alkali halide employing the cation exchange membrane as a diaphragm, a high concentration of the caustic soda solution is obtained with a high current efficiency by means of making the thickness of the partition as thin as possible, lightening the weight of the electrolytic cell, narrowing the distance between the partition and the electrode, and so on, without using the screwing-in method or the explosively welding method for the joining of the metallic partition material having a corrosion resistance in the cathode chamber with that in the anode chamber, leading to the completion of the invention.

In other words, the present invention provides an electrolytic cell, which is divided into the anode chamber and the cathode chamber employing a cation exchange membrane and used for the electrolysis of the aqueous solution of alkali chloride, characterized by consisting of (a) anode chamber and cathode chamber, (b) partition having a thickness of less than 6 mm to separate the anode chamber from the cathode chamber, and (c) ribs joining the electrode with the partition.

According to the invention, either a double electrode type or a single electrode type may be used as an electrolytic cell. As to the partition separating the anode chamber from the cathode chamber, the partition in the side of the anode chamber and that in the side of the cathode chamber are joined under compression by using continuous seam weld method. Also, the lightening in the weight of the electrolytic cell is intended by decreasing the thickness of the partition material. Furthermore, the reduction in the voltage of the electrolytic cell is achieved by narrowing the distance between the partition and the electrode and setting the gap between the anode and the cathode facing to each other through the cation exchange membrane to approach to the thickness of said membrane as nearly as possible.

In following, an example of the double electrode type electrolytic cell of the invention will be illustrated based on the drawings.

BRIEF DESCRIPTION OF THE DRAWING

In FIG. 1, 1 is a frame for the anode chamber in the picture frame form to fix the partition. 2 is a thin plate partition in the anode chamber. 3 is a rib to conduct the electricity from the partition to the anode. 4 is the anode. 5 is a feed nozzle for the saline water. 6 is an ejection nozzle for chlorine gas generating on electrolysis and the solution in the anode chamber. Materials used for 1 to 6 are all based on Ti or Ti alloy having a corrosion resistance to chlorine. 7 is a frame for the cathode chamber in the picture frame form to fix the partition. 11 is a feed nozzle for the pure water or the alkali metal solution. 12 is an ejection nozzle for hydrogen gas generating aon electrolysis. Materials used for 7 to 12 are all based on the metal having a corrosion resistance to alkali metal, for example, nickel or stainless steel. In FIG. 2, 8 is a thin plate partition in the cathode chamber. 9 is a rib to conduct the electricity from the cathode to the partition. 10 is the cathode. 13 is the partition joined by the wavy continuous seam weld.

Figure 1:
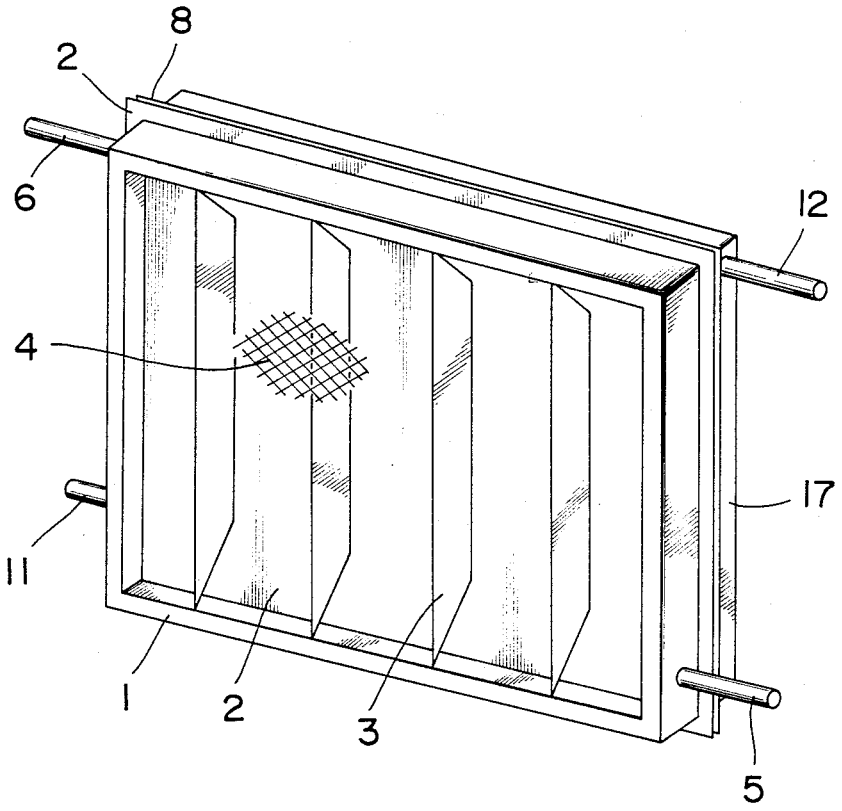
FIG. 1 is a rough sketch showing the construction of the double electrode type electrolytic cell.

When electrolysis is carried out by feeding the saline water or the pure water (or the dilute alkali metal solution) to the fixed portion of the double electrode type electrolytic cell shown in FIG. 1, the current passed through the ion exchange membrane flows in order of cathode→ribs in the cathode chamber→partition in the cathode chamber→seam welded portion→partition in the anode chamber→ribs in the anode chamber→anode and to the next ion exchange membrane. At the anode, anode reaction takes place resulting in the generation of chlorine gas. As said electrode is constructed substantially close to the cation exchange membrane, generated gas by the electrolysis is ejected rapidly backward the electrode without remaining in a space between the membrane and the electrode, and ejected outside the electrolytic cell together with the anode solution through the ejection nozzle located at an upper part of the electrode chamber. At the cathode, hydrogen gas and alkali metal solution are formed by the cathode reaction. The formed products are ejected through the ejection nozzle located at an upper part in almost same flowing state as in the anode chamber.

Next, a relationship of each element used for the electrolytic cell of the invention is explained in detail.

The cation exchange membrane is a membrane generally used, the functional group thereof being carboxylic acid group, sulfonic acid group, mixed acid group thereof, or the like, and may be either hydrocarbon-based cation exchange membrane or perfluorocarbon-based one. Further, both surfaces of the membrane may be plain and smooth, but preferably, both or one of the surfaces be roughtened or have fine porous layers. As the anode, it is recommended that, for example, conventional platinum group metals, their alloys or the oxides of platinum group metals are used through coating or sintering onto the conventional titanium substrate. As the cathode, it is desirable that platinum group metals, nickel, cobalt, chromium or the alloy metals thereof are used, or the metals having a low hydrogen overvoltage are used through metal plating or melt spraying onto the iron-based metal substrate.

The shape of the electrodes in both electrode chambers should be porous bodies such as expand metal, punched metal, wire mesh, etc. holding the gas permeability and the liquid permeability. Moreover, the surface of the electrode contacting with the ion exchange membrane is necessary to be completely connected to the ribs both electrically and mechanically as well as to make plain and smooth by the machining, etc. The dimension of the electrodes is desirable to be fine from a necessity to make the electrode in at least one electrode chamber flexible, and as a preferable state, it can be said that the opening ratio is 30 to 70%, the thickness is 0.1 to 1 mm and the width, that is, the shortest distance from the circumference of the opening portion to the nearest adjacent opening portion is less than 5 mm. Further, in order to make the whole electrode flexible, the electrode joined with ribs connecting the electrode to the partition is divided wholly or partially in the neighborhood of the center between a rib and the other rib, as shown by 10 in FIG. 3. Also, if an angle formed by the surface of the electrode extended from the rib to both sides against the surface of the membrane is equal to or less than 180°, as can be seen from FIG. 4, the surface of the electrode cannot be pressed against said membrane so strongly even if a part of it contacts with the membrane, so that a constant function can be maintained without any mechanical damaging to the membrane, when operating by setting the gap between the anode joined with the anode ribs and the cathode joined with the cathode ribs to approach to the thickness of the cation exchange membrane as nearly as possible through said membrane. And yet, the dimension and the shape of the said fine electrode are not confined to the cathode shown in the figures.

The width of the frame for the electrode chamber is determined by the distance from the surface of the electrode facing to the ion exchange membrane to the surface of the partition contacting with the electrolytic solution in either anode chamber or cathode chamber. Although said distance is preferable to be as narrow as possible to decrease the voltage drop due to the electric resistance of ribs connecting the electrode to the partition electrically, desirable said distance is 10 to 25 mm because of the restriction to make the escape of the generated gas by the electrolysis easy from the electrolytic solution. With regard to the material of the frame for the electrode chambers, the frame for the anode should be made of titanium or titanium containing a minor amount of palladium, and that for the cathode should be made of nickel, stainless steel or iron-based metals.

Figure 2:
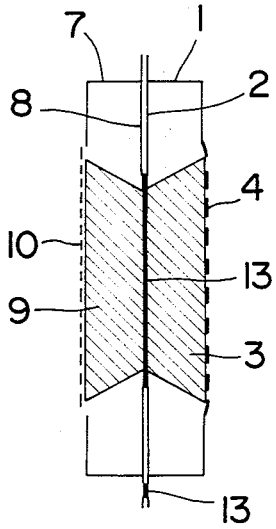
FIG. 2 and FIG. 3 show a vertical and a horizontal cross section of the electrode chamber of the invention, respectively.

FIG. 2 is a vertical cross section of the double electrode type electrolytic cell when the thin plate partition and the fine electrode of the invention are installed as the cathode. In the figure, 4 is the anode. 3 is an anode rib to feed the electricity to the anode. 10 is the cathode. 9 is a cathode rib to conduct the electricity from the cathode to the partition. The respective electrode in each electrode chamber and the ribs are desirable to be joined by welding both mechanically and electrically. 2 is the partition in the anode chamber and 8 is that in the cathode chamber. 13 is the partition joined by the wavy continuous seam weld.

As a material of the partition, titanium is desirable for the side of anode and nickel or stainless steel is desirable for the side of cathode. The thickness of the partition is substantially a sum of the thickness of the partition in the anode side and that in the cathode side. Although the partition is preferable to be as thick as possible in order to realize the better planar property, its thickness should be less than 6 mm from the characteristics of the invention aiming the lightening in the weight of the electrolytic cell. It is not necessary to provide the wavy continuous seam weld on the whole surface of the partition. Welding is sufficient if provided at least by a length equivalent to that of the rib in the neighborhood of the anode rib or the cathode rib. The area of the portion of the wavy continuous seam weld is 1/500 to 1/10 of the effective current area of the cation exchange membrane, preferably 1/100 to 1/20.

Figure 3:
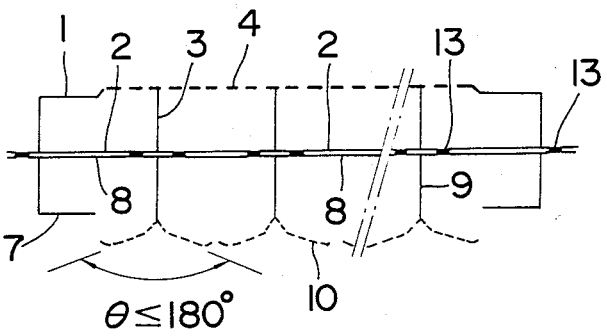
Figure 4:
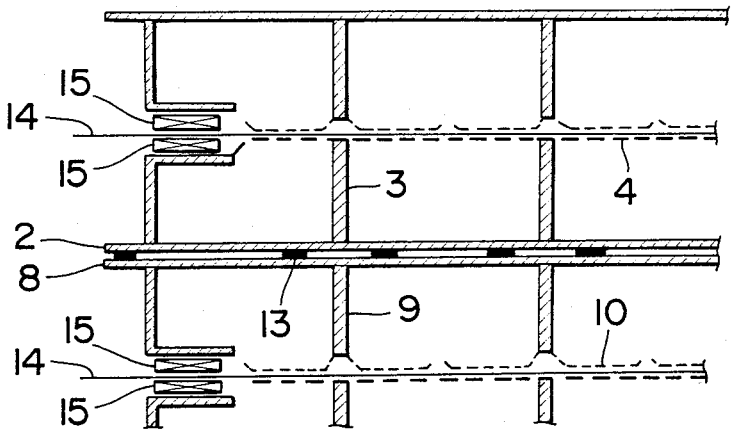
FIG. 4 is a horizontal cross section showing the state assembled the cation exchange membrane, the cathode and the cathode chamber material, the anode and the anode chamber material, gasket, etc.

FIG. 3 is a horizontal cross section of the double electrode type electrolytic cell when the thin plate partition and the fine electrode are installed as the cathode. 10 is the fine electrode. In order to exhibit more flexibility, the surface of the electrode joined there with the ribs is preferable to be set nearer to the partition than the surface of the cathode formed when operating by setting the gap between the anode joined with the anode ribs and the cathode joined with the cathode ribs to approach to the thickness of the cation exchange membrane as nearly as possible through said membrane, as shown in FIG. 4. The distance from the surface of the electrode joined there with the ribs to the surface of the cathode on running is desirably more than 2 mm and less than ten times of the thickness of the electrode.

To make the understanding more clear, a horizontal cross section of the double electrode type electrolytic cell assembled all the constitutional elements is shown in FIG. 4. In FIG. 4, 15 is a gasket made of chloroprene rubber, EPDM or fluoro rubber which dissolves out less heavy metals such as calcium, magnesium, Pb, etc. 4 is the anode and 10 is the cathode. The numbers attached to the other places are same as those described above.

However, the shape, the dimension or the form of the cathode 10 is not confined only to the cathode shown in figure. In following, the applications of the electrolytic cell of the invention are described as examples.

EXAMPLE 1

A titanium plate with a length of one side of 120 cm, that of the other side of 120 cm and a thickness of 1.5 mm was joined under compression by the wavy continuous seam weld with a nickel plate with a length of one side of 120 cm, that of the other side of 120 cm and a thickness of 2.0 mm to obtain a partition separating the anode chamber from the cathode chamber. The width of the frames for the electrode chambers was 15 mm in the side of the anode chamber and 20 mm in the side of the cathode chamber. Eight anode ribs made of titanium plate with a thickness of 2 mm were provided on the anode side of the partition at intervals of 150 mm. Similarly, cathode ribs made of nickel plate with a thickness of 2 mm were provided on the cathode side of the partition at the same intervals as those of the anode ribs.

As the anode, a porous electrode was used which was obtained by the ½ roll processing of the expand metal with ½ inch activated through baking for 4 hours at 360° C. after coated ruthenium chloride on the whole surface of the titanium substrate.

As the cathode, M-60 micro mesh (made at Katsurada Grating Co.) was cut to a width of 150 mm and a length of 1200 mm and joined at the center of the width of 150 mm to the longitudinal direction with the cathode ribs by spot weld, bending to the side of the surface of the membrane so as to an angle formed by the surface of the electrode extended from the joint with the rib to both sides becomes 170°.

As the cation exchange membrane, a copolymer was obtained from monomers $CF_2{=}CF_2$ and $CF_2{=}CF{-}O{-}CF_2{-}CF(CF_3){-}O{-}CF_2{-}SO_2F$ by copolymerizing in 1,1,2-trichloro-1,2,2-trifluoroethane using perfluoropropionylperoxide as an initiator (exchange capacity is 0.91 meq/g as sulfonic acid group) (A polymer). Similarly, a copolymer was obtained from $CF_2{=}CF_2$ and $CF_2{=}CF{-}O{-}CF_2{-}CF(CF_3){-}O{-}CF_2{-}COOCH_3$ (exchange capacity is 1.1 meq/g as carboxylic acid group) (B polymer).

After A polymer and B polymer were molded into films having a thickness of 4 mil and 3 mil, respectively, these two films were heat-pressed to obtain a sheet of film. Then, said film was hydrolyzed for 6 hours at 80° C. with NaOH/methanol (weight ratio 1/1) of the concentration of 10 wt.% to obtain a cation exchange membrane.

Then, the membrane, the cathode and the anode obtained in a way as described above were joined with the frame for electrolysis, the gaskets with a thickness of 2 mm were adhered to the frames for both the anode and the cathode, and a multicell filter press type electrolytic cell was made asembling by turns so as to the electrodes contact to the membrane closely. Finally, after providing the end plates to both ends and tightening up uniformly with tie rod, a double electrode type electrolytic cell was completed.

The direct current source was connected to each bus bar on both ends of the electrolytic cell. Then, the electrolysis of the saline water was carried out under following conditions.

| | |
|---|---|
| Concentration of the feed saline water | 200 g/l |
| Concentration of the produced caustic soda | 35 wt. % |
| Current density | 30 A/dm$^2$ |
| Temperature of electrolytic cell | 90° C. |
| Voltage per electrolytic cell | 3.20 V |

EXAMPLE 2

Using M-60 micro mesh electrode as the cathode which was activated by nickel metal plating employing the nickel both containing Ni salt, thiourea solution of a concentration of 0.01 to 1.0 mol and/or at least one of the salts of oxo acids having an oxidation number of sulfur of less than 5, and ammonium ion having a concentration of more than 10.5 times mol to the concentration of sulfur, the electrolysis was carried out under the same running conditions as Example 1. The voltage of the electrolytic cell thereby was 3.00 V. Furthermore, the inactivation of the activated cathode was never recognized even on the running for 200 days.

What is claimed is:

1. An electrolytic cell used to electrolyze an aqueous solution of alkali chloride which comprises an anode chamber and a cathode chamber divided by a partition, and employing a cation exchange membrane as a diaphragm, and (a) an anode or a cathode in the anode chamber and cathode chamber respectively, each being a porous electrode having an opening ratio of 30 to 70% and a thickness of 0.1 to 1 mm, and the shortest distance from the circumference of a opening which forms one pore in the porous electrode, to that of a nearest adjacent pore opening, being less than 5 mm, and (b) said partition having a thickness of less than 6 mm to separate the anode chamber from the cathode chamber, the portion of the partition on the side of the anode chamber and the portion on the side of the cathode chamber, being joined through a wavy seam weld, and the distance from the surface of said electrodes to the surface of said partition being within the range of 10 to 25 mm, (c) and further comprising ribs joining the electrodes with the partition, and (d) said porous electrode being partly divided in the neighborhood of the center between a rib and another rib, and the angle formed by the surface of the electrode, extended from the rib to both sides against the surface of the membrane, is less than 180° C.

2. The electrolytic cell as described in claim 1, the anode joined with anode ribs and the cathode joined with cathode ribs thereof being set through the cation exchange membrane to approach to the thickness of said membrane as nearly as possible.

3. The electrolytic cell as described in either of claim 1 or claim 2, the material of the anode thereby being titanium and that of the cathode thereby being nickel or stainless steel.

* * * * *